United States Patent [19]

Proffer

[11] Patent Number: 4,625,334

[45] Date of Patent: Dec. 2, 1986

[54] TANDEM RIDER HARNESS

[76] Inventor: Stephen M. Proffer, 273 Kincaid, Eugene, Oreg. 97405

[21] Appl. No.: 750,023

[22] Filed: Jul. 1, 1985

[51] Int. Cl.[4] ..... A41D 1/04

[52] U.S. Cl. ..... 2/1; 2/102; 2/311

[58] Field of Search ..... 182/3; 2/310, 305, 311, 2/102, 94, 44, 300, 304, 312, 2, 1, 321; 224/159, 160, 161, 158; 119/96

[56] References Cited

U.S. PATENT DOCUMENTS

| | | | |
|---|---|---|---|
| 982,376 | 1/1911 | Macfarlane | 224/158 |
| 2,563,766 | 8/1951 | Weinstein et al. | 119/96 |
| 3,562,812 | 2/1971 | Greggains | 2/94 |
| 3,564,616 | 2/1971 | Battaglia | 2/311 |
| 3,840,902 | 10/1974 | McNeill | 2/311 |
| 3,896,499 | 7/1975 | Kelly | 2/311 |
| 4,028,742 | 6/1977 | Marquis | 2/305 |
| 4,324,205 | 4/1982 | Goldmacher | 2/305 |
| 4,396,013 | 8/1983 | Hasslinger | 128/134 |
| 4,429,419 | 2/1984 | Snyder | 2/305 |

*Primary Examiner*—Louis K. Rimrodt
*Assistant Examiner*—Joseph S. Machuga
*Attorney, Agent, or Firm*—James D. Givnan, Jr.

[57] ABSTRACT

A safety harness constructed of webbing for wear by the forward rider of tandem riders and having straps located so as to provide optional use pairs of handholds to the rearward rider. A first pair of handholds is located forwardly while a second pair is somewhat rearwardly thereof to provide the rearward rider a choice of handholds. The handholds have folded portions.

6 Claims, 4 Drawing Figures

TANDEM RIDER HARNESS

BACKGROUND OF THE INVENTION

The present invention pertains generally to a harness for wear by the forward rider of a pair of riders disposed in tandem fashion.

The rider of motorcycles and three wheel all terrain vehicles, termed ATV's, in tandem manner puts the rearward rider at some risk in that he or she has no handholds to grip and must rely on holding onto or about the forward rider's waist. This problem is accentuated when the vehicle is used in "off the road" riding over rough terrain.

While other belts and harnesses have been proposed which provide handholds for a tandem passenger, such arrangements, for one reason or another, have not been widely accepted. It is suspicioned that the cost of manufacture and resultant selling price are too high for the typical recreational vehicle rider. A further drawback to known belt and harness arrangements is that most do not provide a handhold position to the tandem passenger to best suit the rider's physical characteristics and position with respect to the forward rider.

Of interest in the known prior art are U.S. Pat. Nos. 3,896,499; 4,324,205 and 4,411,222. The first noted patent discloses a belt worn by a vehicle operator providing a tandem passenger horizontally spaced handgrips. The secondly noted patent discloses a harness also for wear by a vehicle operator and providing a tandem passenger optional pairs of handholds mounted forwardly and rearwardly on an operaator worn harness. The handholds are of semi-rigid material. The last noted patent discloses an operator worn belt having a pair of handholds which are positionable along a segment of the belt.

SUMMARY OF THE PRESENT INVENTION

The present invention is embodied in a harness of strap construction which is comfortably worn by the forward rider of a tandem pair of riders and provides handholds for the passenger.

The present harness provides pairs of handholds spaced at different distances from the passenger for convenience sake. Strap segments are shaped so as to incorporate handholds in a practical manner while assuring a comfortable grip for the tandem passenger. A harness cross member reinforces the handhold against rearward displacement during use. Strap segments are folded in such a manner to provide a curved edge conducive to comfortable gripping by the passenger.

Important objectives of the present harness include the provision of a rider worn harness which provides a tandem mounted passenger a choice of handholds to best suit individual physical characteristics; the provision of a harness having folded edge webbing segments constituting handholds; the provision of a harness of low cost manufacture which is of light weight and may be worn over bulky outer garments; the provision of a harness wherein handholds are reinforced by a cross member spaced from the belt and in general parallel releationship thereto; the provision of a harness that may carry a detachable case forwardly of the rider's chest.

DETAILED DESCRIPTION OF THE PREFERRED EMBODIMENTS

Figure 1:
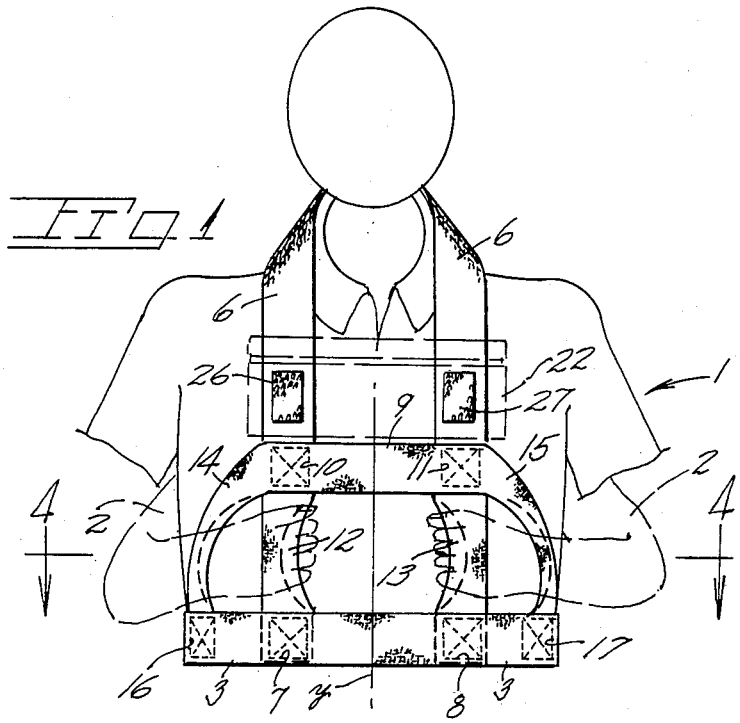
FIG. 1 is a front elevational view of the present harness in place on the operator's upper torso with a tandem passenger's arms shown in phantom lines.
Figure 3:
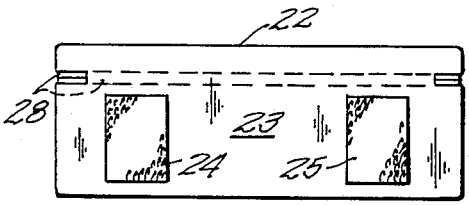
FIG. 3 is a rear elevational view of a case adapted for detachable securement to the harness.
Figure 2:
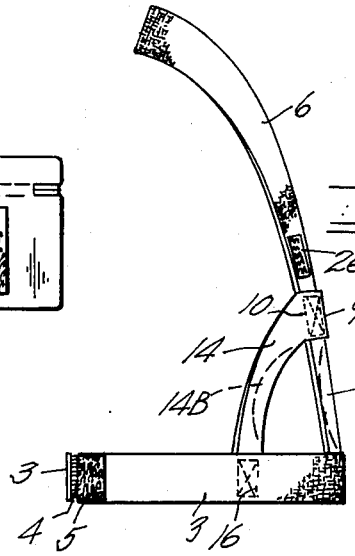
FIG. 2 is a right side elevational view taken from the left-hand side of FIG. 1 with the harness removed from the upper torso.

With continuing attention to the drawings, the reference numeral 1 thereon indicates generally the upper torso of a forward rider or operator of a pair of tandem riders. Indicated at 2 are the arms of the rearward tandem passenger.

The present harness is of strap construction including a belt 3 for passage about the waist of the forward rider. The belt is suitably secured in place as by overlapping belt portions provided with closure means such as lengths of fabric closure material of hook and loop construction at 4 and 5. If desired, belt 3 may be equipped with buckle type closure means.

Strap means of the harness includes a strap 6 secured as by stitching at 7 and 8 to belt 3 and extending upwardly therefrom to overlie the frontal upper torso of forward rider 1. In suitable embodiment of the harness strap 6 may be a continuous strap for passage about the base of the neck as shown.

The strap means further includes a strap cross member 9 secured at 10 and 11 to strap 6 to retain the latter against rearward displacement.

Strap segments at 12 and 13 of strap 6 constitute a first pair of handholds. Strap segments at 14 and 15 which may be continuations of cross member 9 constitute a second pair of handholds, and terminate in stitched attachment at 16 and 17 with belt 3. A slightly bowed configuration is thereby imparted to strap segments 14 and 15.

The first and second pairs of handholds are reinforced against displacement by belt 3 and cross member 9.

It is to be noted that the pairs of handholds are offset different distances from a frontal harness center indicated at y.

Figure 4:
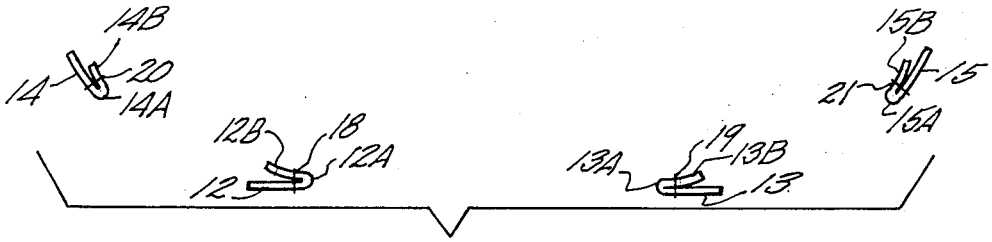
FIG. 4 is a horizontal sectional view taken downwardly along line 4—4 of FIG. 1 and showing folded strap handholds.

Strap segments 12–13 and 14–15 are preferably of folded configuration with the forwardly disposed edge portion (relative the harness wearer) folded inwardly and rearwardly to provide, as shown in FIG. 4, rounded strap surfaces at 12A-13A and 14A-15A to provide comfortable handholds for the tandem passenger. Stitching at 18, 19, 20 and 21 retains the strap segments in such folded configuration. Folded strap edge portions are at 12B-13B and 14B-15B.

A case at 22 for the storage of personal or miscellaneous items includes a back wall 23 on which closure fabric patches 24–25 are mounted to enable removable securement to patches 26–27 secured in place on strap 6 proximate the user's chest. Such patches may be of the well known hook and loop type marketed under the registered trademark VELCRO. The case includes zipper at 28 extending partially about the case to provide a lid portion integral with back wall 23.

The harness is of adequate strength when made from two inch wide nylon webbing. The tandem passenger, depending on arm length and physical characteristics of the riders, may grasp either the first or second pair of handholds or alternate therebetween to allay arm fatigue.

While I have shown but one embodiment of the invention, it will be apparent to those skilled in the art that the invention may be embodied still otherwise without departing from the spirit and scope of the invention.

Having thus described the invention, what is desired to be secured in Letters Patents is:

I claim:

1. A safety harness for wear by the forward rider of tandem riders, said harness comprising, a belt including means for adjustably applying same about the forward riders waist, strap means for overlying the forward riders frontal torso area and terminating downwardly in attachment to said belt, and said strap means having segments constituting first and second pairs of handholds proximate the frontal torso area for grasping by the rearwardmost rider of the tandem riders, said first pair of handholds being spaced a lesser distance apart than said second pair of handholds, said strap means additionally including a cross member which retains said first pair of handholds and said second pair of handholds against displacement during harness use.

2. The harness claimed in claim 1 wherein said strap means includes a portion for passage about the forward riders neck.

3. The harness claimed in claim 1 wherein said second pair of handholds are inclined relative to said belt.

4. The harness claimed in claim 1 wherein at least some of said strap segments include folded edge portions.

5. The harness claimed in claim 4 wherein said some strap segments are stitched to retain said folded edge portions.

6. A safety harness for wear by the forward rider of tandem riders, said harness comprising, a belt including means for adjustably applying same about the forward riders waist, strap means for overlying the forward riders frontal torso area and terminating downwardly in attachment to said belt, said strap means having segments constituting handhold proximate the frontal torso area for grasping by the rearwardmost rider of the tandem riders, a carrying case for miscellaneous items and including a back wall, and cooperating fabric closure pieces on said back wall of the case and on said strap means and cooperating to detachably mount said case in front of the forward riders torso.

* * * * *